US009238301B2

(12) United States Patent
Streich et al.

(10) Patent No.: US 9,238,301 B2
(45) **Date of Patent: *Jan. 19, 2016**

(54) TOOL CONTAINER

(75) Inventors: John P. Streich, Towson, MD (US); Daniel G. Findle, White Hall, MD (US); Patrick S. Keenan, Pittsburgh, PA (US); David Namey, Jr., Pittsburgh, PA (US)

(73) Assignee: Black & Decker Inc., Newark, DE (US)

( * ) Notice: Subject to any disclaimer, the term of this patent is extended or adjusted under 35 U.S.C. 154(b) by 738 days.

This patent is subject to a terminal disclaimer.

(21) Appl. No.: 11/873,620

(22) Filed: Oct. 17, 2007

(65) Prior Publication Data

US 2008/0035508 A1 Feb. 14, 2008

Related U.S. Application Data

(62) Division of application No. 10/772,617, filed on Feb. 5, 2004, now Pat. No. 7,316,309, which is a division of application No. 09/134,109, filed on Aug. 14, 1998, now Pat. No. 6,755,302.

(51) Int. Cl.

| | |
|---|---|
| ***B25H 3/02*** | (2006.01) |
| ***A45C 5/00*** | (2006.01) |
| ***A45C 13/02*** | (2006.01) |
| ***B25H 3/00*** | (2006.01) |
| ***B25H 3/06*** | (2006.01) |
| ***E05B 65/52*** | (2006.01) |

(52) U.S. Cl.

CPC *B25H 3/021* (2013.01); *A45C 5/00* (2013.01); *A45C 13/02* (2013.01); *B25H 3/003* (2013.01); *B25H 3/023* (2013.01); *B25H 3/06* (2013.01); *E05B 65/5238* (2013.01); *Y10S 292/48* (2013.01); *Y10S 292/50* (2013.01); *Y10T 24/45005* (2015.01); *Y10T 24/45157* (2015.01); *Y10T 24/45168* (2015.01); *Y10T 29/49826* (2015.01); *Y10T 292/096* (2015.04); *Y10T 292/432* (2015.04)

(58) Field of Classification Search

CPC ..... B25H 1/00; B25H 3/003; B25H 3/021; Y10T 24/45005; Y10T 24/45157; Y10T 24/45168; Y10T 29/49947

USPC ..... 211/69, 70.6; 206/472–475, 372, 373, 206/349, 377–379; 220/4.31; 21/69, 70.6

See application file for complete search history.

(56) References Cited

U.S. PATENT DOCUMENTS

| | | | | |
|---|---|---|---|---|
| 1,623,610 | A | 4/1927 | Zeindlhofer, Sr. | |
| 1,807,220 | A | 5/1931 | Leberman | |
| 2,006,268 | A | 6/1935 | Geiger et al. | |
| 2,027,004 | A | 1/1936 | Stewart | |
| 2,064,351 | A * | 12/1936 | McNaught et al. | 206/375 |

(Continued)

FOREIGN PATENT DOCUMENTS

| | | |
|---|---|---|
| DE | 33 06 348 | 8/1984 |

*Primary Examiner* — Anthony Stashick
*Assistant Examiner* — Kaushikkumar Desai
(74) *Attorney, Agent, or Firm* — Scott B. Markow

(57) ABSTRACT

A tool container has a pair of housing members pivotally coupled with one another to provide an opened and closed position. At least one of the members defines a cavity to receive tools. The cavity is defined by a base and a wall extending from the base. A tool retaining insert is permanently secured in the cavity. The insert and wall include tenons and grooves to secure the insert in the housing member. Also, an arcuate locking mechanism is included to maintain the pair of housing members in a closed position.

11 Claims, 11 Drawing Sheets

(56) References Cited

U.S. PATENT DOCUMENTS

| | | | | | |
|---|---|---|---|---|---|
| 2,844,244 | A | * | 7/1958 | Hanson | 206/379 |
| 2,880,857 | A | * | 4/1959 | Parsons et al. | 206/379 |
| 3,200,983 | A | * | 8/1965 | Walter | 220/533 |
| 3,370,697 | A | | 2/1968 | Levey et al. | |
| 3,660,875 | A | | 5/1972 | Gutman | |
| 3,710,761 | A | | 1/1973 | Gregory | |
| 3,837,692 | A | | 9/1974 | Ayers et al. | |
| 4,048,051 | A | | 9/1977 | Gretz | |
| 4,153,178 | A | | 5/1979 | Weavers | |
| 4,293,074 | A | * | 10/1981 | Dunsky | 206/572 |
| 4,302,990 | A | * | 12/1981 | Chrichton et al. | 81/60 |
| 4,489,830 | A | * | 12/1984 | Charlebois et al. | 385/135 |
| 4,573,575 | A | | 3/1986 | Bergrath et al. | |
| 4,576,307 | A | | 3/1986 | Frydenberg | |
| 4,615,464 | A | | 10/1986 | Byrns | |
| 4,717,024 | A | | 1/1988 | Djezovic | |
| 4,740,655 | A | | 4/1988 | Ford | |
| 4,741,441 | A | * | 5/1988 | Keffeler | 206/532 |
| 4,889,254 | A | | 12/1989 | Vola | |
| 4,949,436 | A | | 8/1990 | Anscher | |
| 4,959,199 | A | * | 9/1990 | Brewer | 422/300 |
| 4,974,740 | A | | 12/1990 | Niles et al. | |
| 5,011,018 | A | * | 4/1991 | Keffeler | 206/532 |
| 5,031,768 | A | * | 7/1991 | Fischer | 206/370 |
| 5,215,205 | A | * | 6/1993 | Behlman | 220/4.31 |
| 5,217,115 | A | * | 6/1993 | Purkapile | 206/373 |
| 5,222,619 | A | | 6/1993 | Gregory | |
| 5,275,027 | A | | 1/1994 | Eklof et al. | |
| 5,279,800 | A | * | 1/1994 | Berry, Jr. | 422/300 |
| 5,283,932 | A | | 2/1994 | Richardson et al. | |
| 5,316,159 | A | | 5/1994 | Douglas et al. | |
| 5,341,926 | A | | 8/1994 | Leben | |
| 5,379,540 | A | * | 1/1995 | Howard | 40/558 |
| 5,384,103 | A | * | 1/1995 | Miller | 422/310 |
| 5,426,830 | A | | 6/1995 | Richardson et al. | |
| 5,429,235 | A | * | 7/1995 | Chen | 206/373 |
| 5,442,838 | A | | 8/1995 | Richardson et al. | |
| 5,454,478 | A | * | 10/1995 | Everson | 220/23.83 |
| 5,492,671 | A | * | 2/1996 | Krafft | 422/26 |
| 5,499,329 | A | * | 3/1996 | Motoyama et al. | 715/236 |
| 5,524,915 | A | * | 6/1996 | Liu | 280/30 |
| 5,525,314 | A | * | 6/1996 | Hurson | 422/300 |
| 5,535,881 | A | * | 7/1996 | Krivec | 206/376 |
| 5,553,710 | A | * | 9/1996 | Takama | 206/561 |
| 5,560,572 | A | | 10/1996 | Osborn et al. | |
| 5,570,784 | A | * | 11/1996 | Sidabras et al. | 206/378 |
| 5,588,240 | A | | 12/1996 | Zilliox | |
| 5,593,058 | A | * | 1/1997 | Spencer et al. | 220/4.31 |
| 5,607,215 | A | * | 3/1997 | Pacetti et al. | 312/348.3 |
| 5,664,856 | A | * | 9/1997 | Pacetti | 312/348.3 |
| 5,709,014 | A | | 1/1998 | Takahashi | |
| 5,826,719 | A | * | 10/1998 | Chen | 206/373 |
| D400,709 | S | * | 11/1998 | Chang | D3/294 |
| 5,878,907 | A | | 3/1999 | Graf | |
| 5,896,627 | A | | 4/1999 | Cappel et al. | |
| 5,913,422 | A | * | 6/1999 | Cote et al. | 206/370 |
| 5,988,387 | A | | 11/1999 | Staal et al. | |
| 5,996,187 | A | | 12/1999 | Tanaka et al. | |
| D418,977 | S | | 1/2000 | Streich | |
| 6,125,668 | A | | 10/2000 | Belden, Jr. | |
| D434,561 | S | * | 12/2000 | Vasudeva | D3/282 |
| 6,213,296 | B1 | * | 4/2001 | Streich et al. | 206/373 |
| 6,216,858 | B1 | * | 4/2001 | Chiu | 206/234 |
| D448,167 | S | | 9/2001 | Pangerc et al. | |
| 6,405,864 | B1 | * | 6/2002 | Streich et al. | 206/373 |
| 6,442,804 | B2 | | 9/2002 | Turvey et al. | |
| 6,554,327 | B1 | | 4/2003 | Riley | |
| 6,662,413 | B2 | | 12/2003 | Glover | |
| 6,755,302 | B1 | * | 6/2004 | Streich et al. | 206/373 |
| 6,976,787 | B2 | | 12/2005 | Plourde | |
| 6,981,299 | B2 | | 1/2006 | Savicki, Sr. | |
| 7,322,470 | B2 | * | 1/2008 | Brunson | 206/372 |

* cited by examiner

TOOL CONTAINER

CROSS REFERENCE TO RELATED APPLICATION

This is a divisional of U.S. Ser. No. 10/772,617, filed Feb. 5, 2004, which is a divisional of an application filed Aug. 14, 1998 and assigned U.S. Ser. No. 09/134,109.

BACKGROUND OF THE INVENTION

The present invention relates to tool containers and, more specifically, to containers which include inserts to retain the tools within the container.

Tool users, whether casual or professional, desire to maintain their tools in some type of organized fashion. Tool organization enables a user to readily find the tool, use it, and return it to its place. Thus, several types of tool containers have been provided to serve such a function.

While the tool containers work satisfactorily for their designed purpose, these containers have their drawbacks. One such drawback is some containers are not rugged enough to withstand the day-to-day punishment which a professional user subjects his tools to. Also, the containers may be large, awkward and difficult to be handled by the user. Further, the containers may not provide an aesthetic appearance.

SUMMARY OF THE INVENTION

The present invention provides the art with a tool container which overcomes the above shortcomings. The present invention provides the art with a tool case which is durable and easily manipulated by the user. The tool case is rugged enough to withstand the daily use of a professional user, while providing a pleasing aesthetic appearance.

In accordance with one aspect of the invention, a tool container comprises a pair of housing members pivotally coupled with one another. The pair of housing members open and close with respect to one another. At least one member defines a cavity to receive tools in the cavity. The cavity is defined by a base and a peripheral wall extending from the base. An insert for retaining tools is permanently secured in the housing. The insert has a surface mechanism to secure with the housing member base or wall. Also, a mechanism is present to lock the pair of housing members together in a closed position. The surface mechanism to retain the insert within the housing may be comprised of a plurality of alternating dove-tail recesses and tenons on the insert and the walls. The tenons are received by opposing recesses. The tenons have a front face which is angled with respect to vertical at about one (1°) degree. Also, the recesses have a surface angled corresponding to the front face of the tenon for locking the insert within the cavity. Alternatively, the housing base may have a roughed surface. Likewise, the insert would also have a roughed surface wherein the rough surfaces are ultrasonically welded together. The locking mechanism includes an arcuate rail member on each of the housing members and a latch with a channel to receive the rail members. The latch moves on the rail from a locked to an unlocked position. The rail members, as well as the channel for receiving the rail are both arcuate in a longitudinal as well as lateral direction. Further, the latch includes a first and second set of indicia which indicate a locked and unlocked position as well as directional movements. The latch member includes first and second members; the first member provides rigidity and includes a portion which projects through the second member. The first and second indicia have contrasting colors with respect to one another.

In accordance with a second aspect of the invention, a latch is provided to retain the housing pairs in locked and unlocked positions. The latch includes a channel defined by an arcuate base surface, a pair of side walls extending from the base, and a pair of flanges extending from the side walls toward one another. The base surface is arcuate along both the longitudinal and lateral axes. One of the flanges includes a cut-out to enhance coupling with the housing pair. The latch includes two sets of indicia, one to indicate a locked and unlocked position, while the other indicates directional movement. The latch is comprised of a first and second member, the first member providing rigidity. A portion of the first member extends through the second member to provide an indicia member. Also, the indicia member is substantially flush with the second member.

In accordance with a third aspect of the invention, a retaining insert is provided to retain tools within the container. The insert includes a body member with a plurality of V-shaped tool receiving cradles. A mechanism to retain the tools within the cradle is coupled with the body adjacent the tool receiving cradles. The mechanism and V-shaped cradles self-orientate the tool bits in the cradle. The mechanism includes fingers which extend from the insert. The fingers, if necessary, rotate the tool bit to seat the tool bit with an apex of the tool bit in the apex of the V-shaped tool receiving channel. The V-shaped cradle has an aperture dividing the cradle into two spaced V-shaped cradle portions. The two fingers are positioned adjacent the aperture to enable flexing of the fingers which, in turn, enable the fingers to spread apart to receive a tool bit in the V-shaped cradle. Also, a wall member is positioned at an end of the insert adjacent the tool receiving V-shaped cradles. The inserts include a tenon and a recess to couple the insert with a container to position the insert in a plurality of positions within the container. The inserts may include eight or five V-shaped tool receiving cradles.

In accordance with a fourth aspect of the invention, a tool container comprises a housing member defining a cavity to receive tools. The cavity is defined by a base and a wall extending from the base. A plurality of inserts to retain tools are capable of being multi-positioned in the housing member. The inserts, after determining a position in the housing, are permanently secured in the cavity. The inserts include a surface to secure the housing member with a base or wall. The surface may include alternating tenons and grooves for mating with corresponding wall tenons and grooves. Likewise, the walls may include either a cut-out or projection member where the inserts include an opposing mating projection member or cut-out to enable multi-positions for the inserts within the housing.

In accordance with a fifth aspect of the invention, a method of making a tool container comprises providing a housing member having a cavity defined by a base and a wall extending from the base. Also provided is at least one tool receiving insert having a plurality of tool receiving members. The wall or base and the at least one tool receiving insert have a mating mechanism. The insert may be positioned in one of a plurality of positions within the cavity. At the positioning points, the mating mechanisms mate with one another. The insert is secured into the cavity. A plurality of inserts may be provided and positioned and secured within the cavity. Also, a second housing member may be hingedly secured to the first housing member to provide a second cavity wherein additional inserts may be positioned and secured to the second housing member.

In accordance with a sixth aspect of the invention, a method of securing a tool bit in a tool retaining insert comprises providing a tool retaining insert having at least one V-shaped tool receiving cradle. Two fingers extend from the insert adjacent the V-shaped receiving cradle. A tool with a polygonal cross-section is provided. The tool is positioned on the fingers. A force is applied onto the tool to spread the fingers apart so that the tool enters into the fingers. Upon forcing the tool past the fingers into the V-shaped cradle, as the tool passes the fingers, if necessary, the tool is rotated such that an apex of the tool seats in the apex of the V-shaped cradle self-orientating the tool in the cradle. If rotation of the tool is not necessary, the apex of the tool will seat directly within the apex of the V-shaped cradle.

Other objects, features and advantages of the present invention will become more fully apparent from the following detailed description of the preferred embodiment and the accompanying drawings.

DETAILED DESCRIPTION OF THE PREFERRED EMBODIMENT

Figure 1:
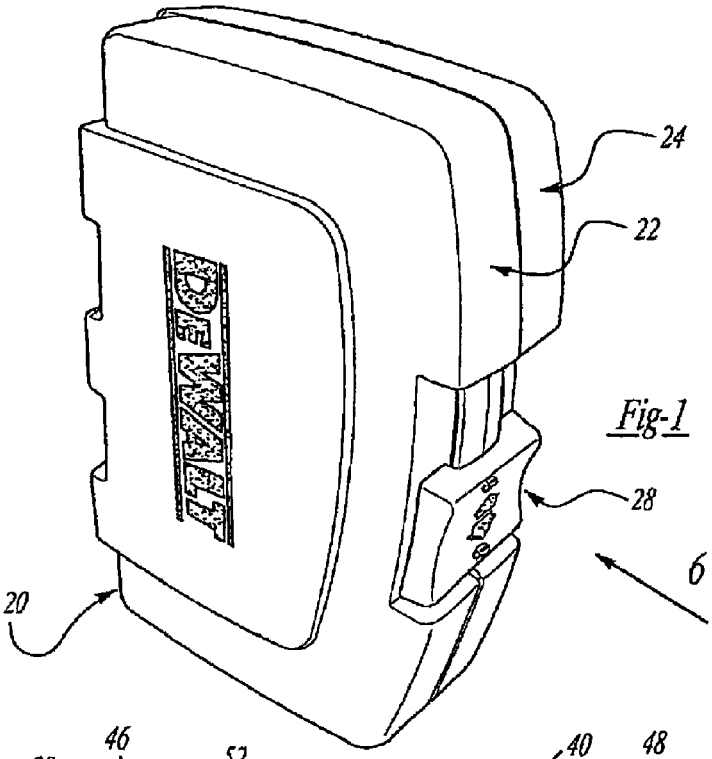
FIG. 1 is a perspective view of a tool container of the present invention in a closed position.

Turning to the figures, particularly FIG. 1, a tool container is shown and designated with the reference numeral 20. The tool container 20 includes two housing members 22 and 24, which are pivotally secured together by a hinge 26. The housing members 22, 24 also include a locking mechanism 28 to maintain the container 20 in a closed position.

Figure 2:
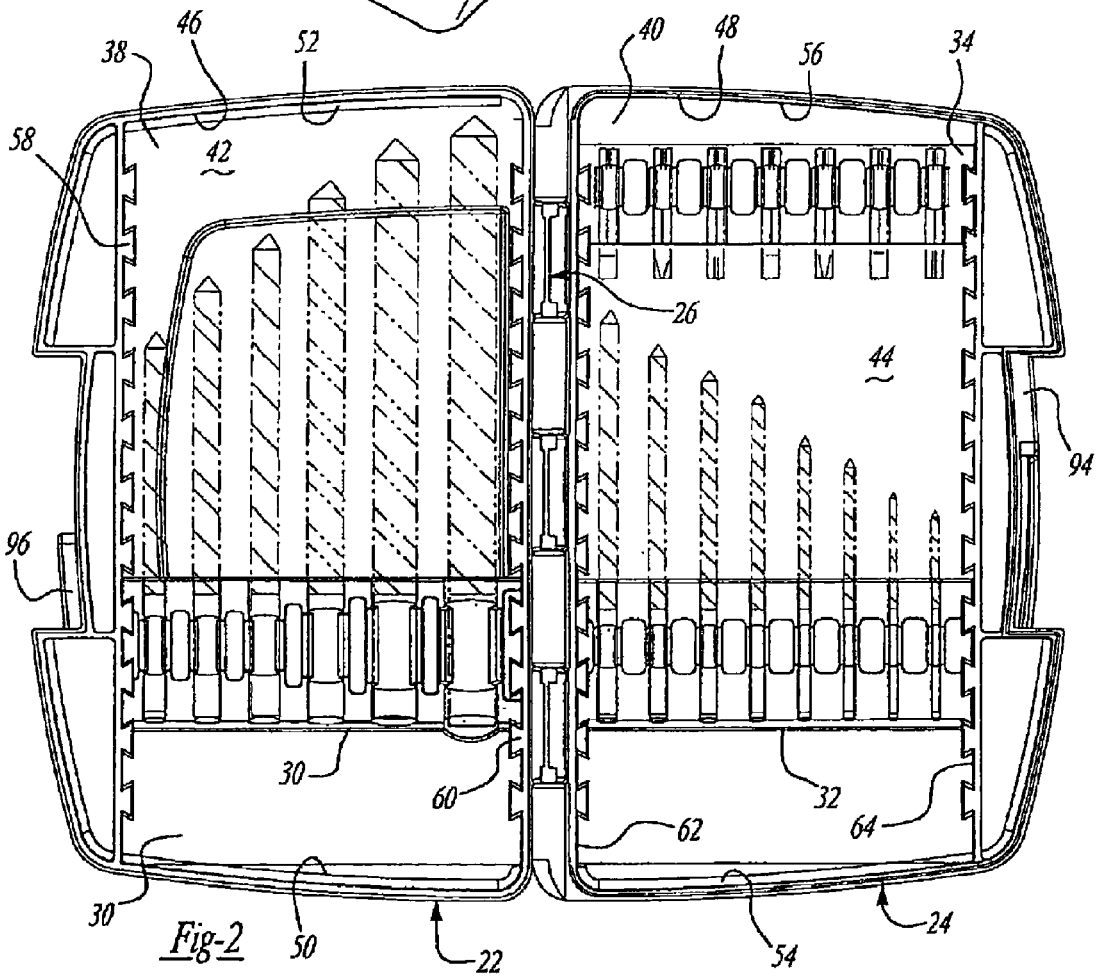
FIG. 2 is a perspective view of the tool container of the present invention in an open position.

Turning to FIG. 2, the container 20 is illustrated in an open position. Each half may include one or more tool retaining inserts 30, 32, 34. The tool retaining inserts may retain tool bits or the like, such as drill bits and screwdriver bits.

Figure 3:
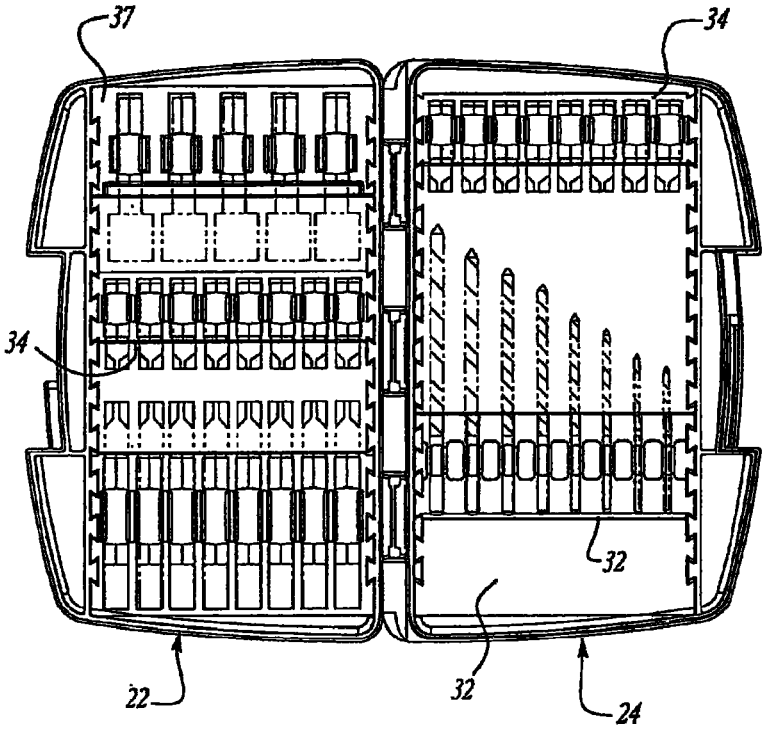
FIG. 3 is a plan view like that of FIG. 2 illustrating multiple inserts.
Figure 4:
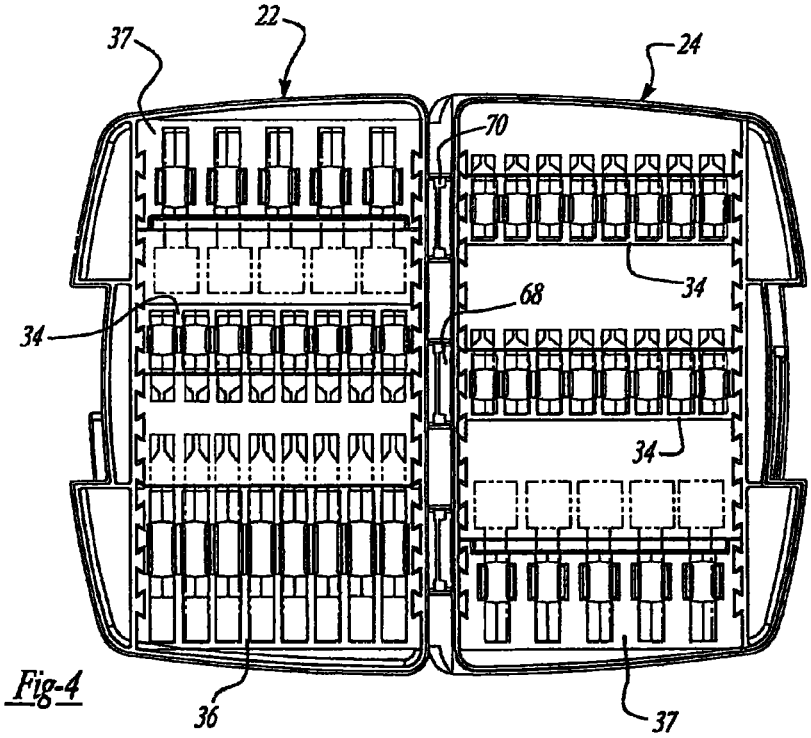
FIG. 4 is a view of FIG. 2 illustrating multiple inserts positioned in other multiple positions.

FIGS. 3 and 4 illustrate embodiments like FIG. 2. Here, inserts 32, 34, 36 and 37 are shown in multiple positions in the housing members 22 and 24. As can be seen, the inserts may be positioned at a plurality of different predetermined positions or orientations in each housing member 22, 24. Any one of the insert and housing mating surfaces enable the accurate positioning and orientating in the housing members. The plurality of positions enhances the versatility of the tool container.

The housing members 22 and 24 are substantially similar and include cavities 38 and 40 defined by a base 42, 44 and a peripheral wall 46, 48. The housing members 22, 24 have an overall rectangular shape with the peripheral walls 46, 48 defining lateral walls 50, 52, 54, 56 and longitudinal walls 58, 60, 62, 64. The longitudinal walls 60 and 62 at their open ends include hinge members 68. Hinge member 68 has an overall C-shape which snap fits onto the pin member 70. The pin members 70 are separated by barrel members 72. Thus, the hinge 26 enables the housing members 22 and 24 to pivotally open and close the container 20.

Figure 5:
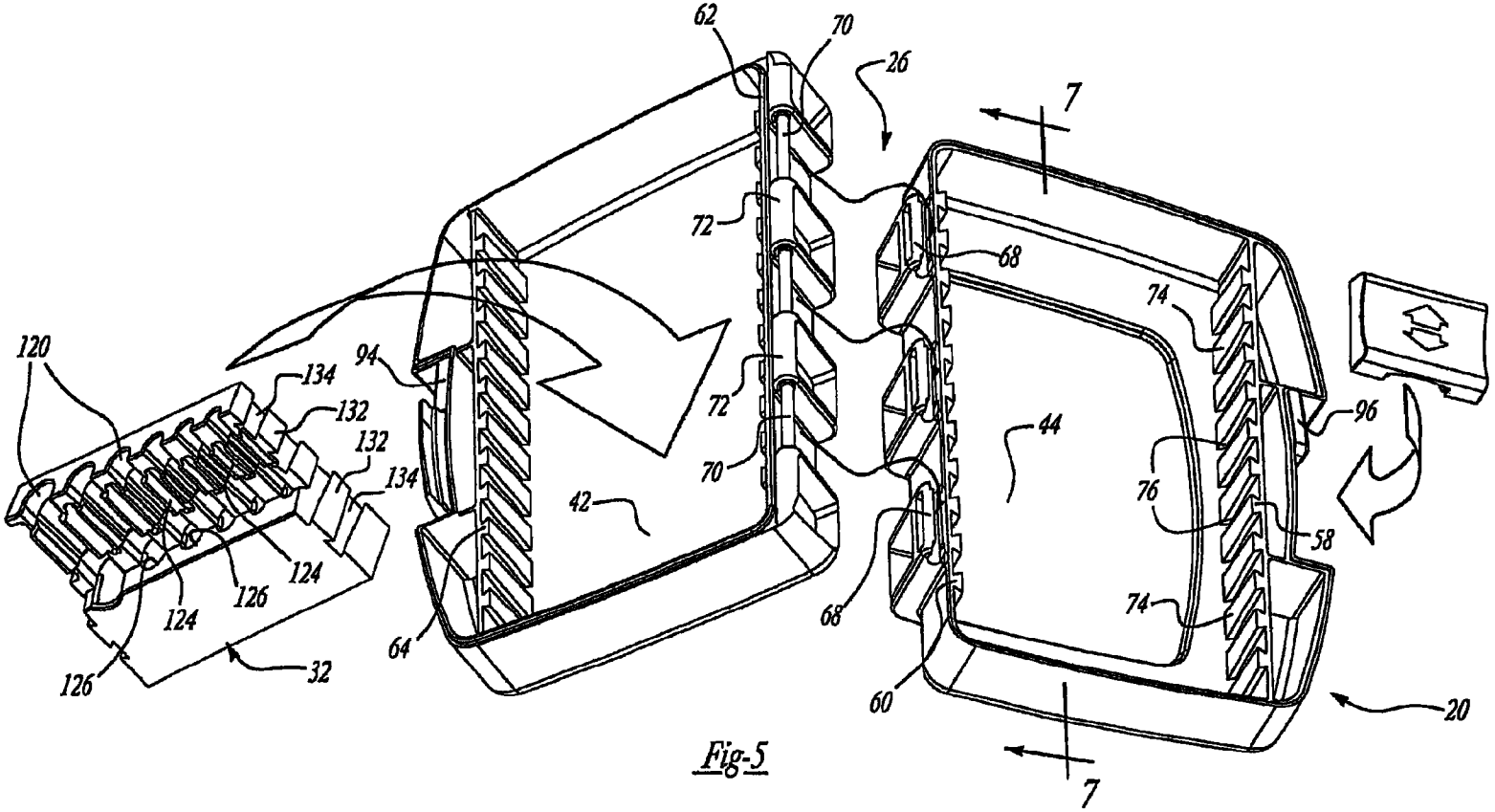
FIG. 5 is an exploded view of FIG. 2.
Figure 7:
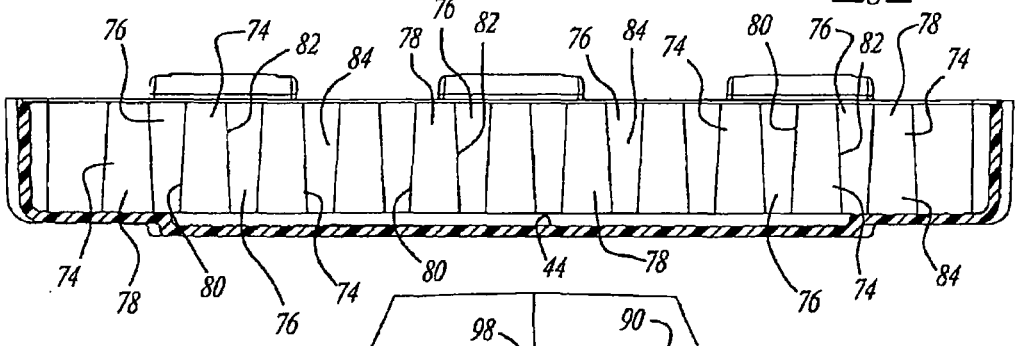
FIG. 7 is a plan view of FIG. 5 in the direction of arrow 7.
Figure 10:
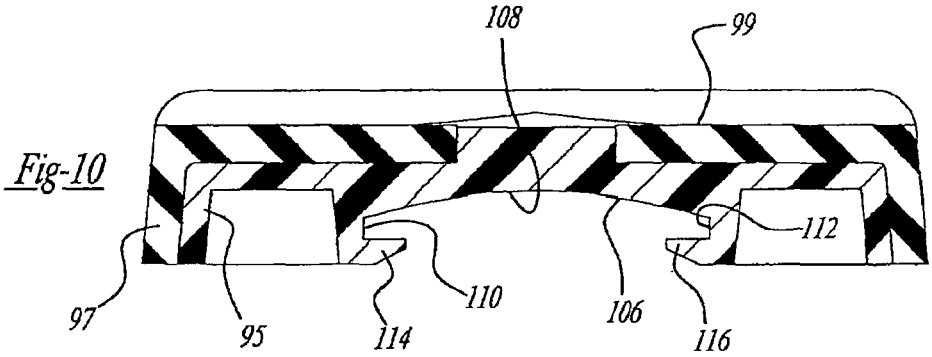
FIG. 10 is a cross-section view through the latch of FIG. 9.

Referring to FIGS. 5 and 7, the longitudinal walls 58, 60, 62, 64 include a plurality of alternating dove-tail tenons 74 and recesses 76. The tenons 74 are narrower at the top and become wider at the base, having an overall trapezoidal shape. The tenons 74 have a front face 78 which is angled with respect to vertical at an angle of about one (1°) degree. Also, the tenons 74 have side faces 80 and 82 which also define the sides of the recesses 76, which are likewise angled with respect to vertical at an angle of about two (2°) degrees. Further, the recesses 76, which are defined by the side faces 80 and 82, include a rear face 84. The rear face 84 is angled with respect to the vertical. Also, the recess 76 has a larger opening at the top of the wall which becomes narrow or tapered near the base 42, 44 to have an overall trapezoidal shape. The tenons 74 and recesses 76 have a dove-tail shape and are adapted to receive the corresponding dove-tail recesses and tenons, respectively, of the tool retaining inserts 30, 32, 34, 36, 37 as seen in FIG. 10. Once the tenons and recesses of the walls and inserts are coupled with one another, due to the wedging action of the friction forces, they become substantially permanently retained within the housing cavities.

Figure 6:
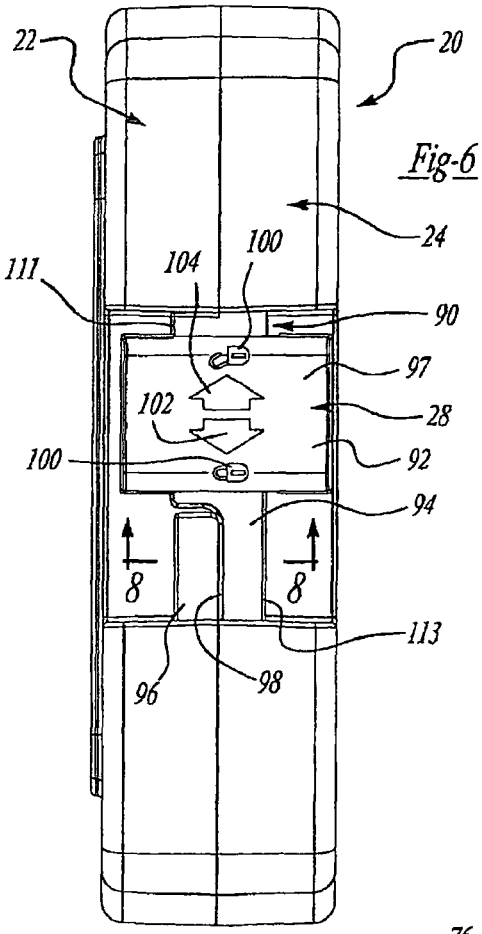
FIG. 6 is a plan view of FIG. 1 in the direction of arrow 6.
Figure 8:
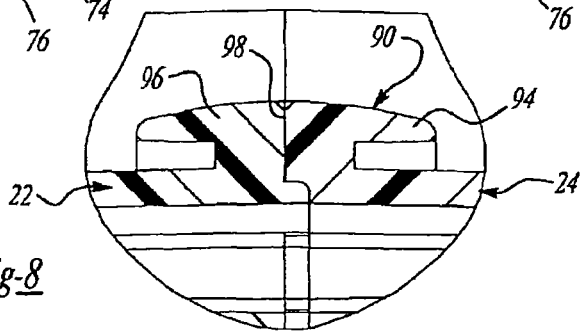
FIG. 8 is a cross-section view of FIG. 6 along line 8-8 thereof.

Referring now to FIGS. 6 and 8, the locking mechanism 28 includes a rail 90 and a latch 92. The rail 90 includes rail portions 94 and 96 on the housing pair 22 and 24. The housing portion 94 extends above the longitudinal wall 64 to retain the latch 92 when the latch is in an unlocked position. The rail portion 96, approximately half the width of the rail 90, fits into a cut-out 98 in the rail portion 94 so that in a closed position, as illustrated in FIG. 6, the rail 90 appears continuous so that when the latch is moved to a locked position, the rail portion 96 as well as the rail portion 94 are held together by the latch 92.

With respect to FIGS. 2-5, the rail portions 94 and 96 are arcuate along the longitudinal axis of the rail 90. Likewise, the rail portions 94 and 96 are arcuate in a direction transverse to the longitudinal axis as seen in FIG. 8. Thus, the rail 90 is arcuate in two planes. The arc of the rail in the longitudinal direction follows with the overall contour of the tool container. The transverse arc enables better removal of the housing member from the mold die.

Figure 9:
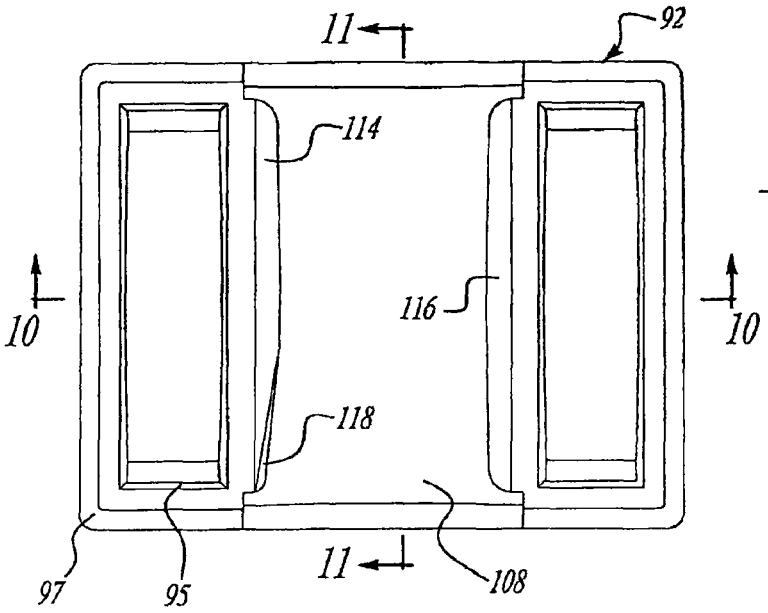
FIG. 9 is a rear plan view of the latch in accordance with the present invention.
Figure 11:
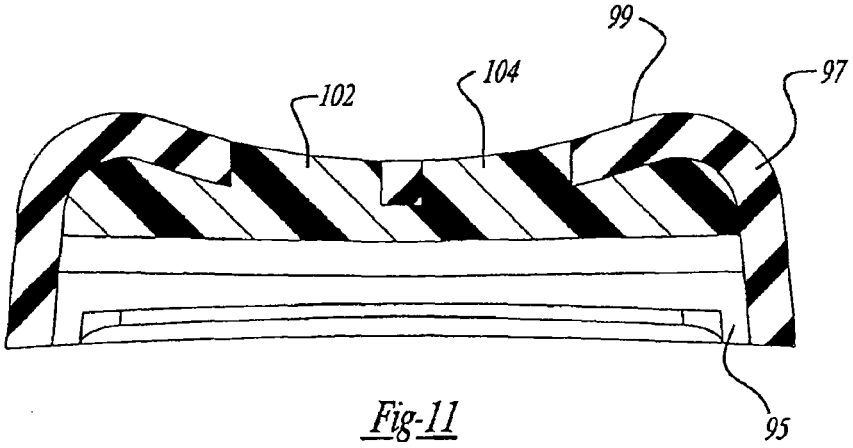
FIG. 11 is another cross-section view through the latch in FIG. 9.
Figure 12:
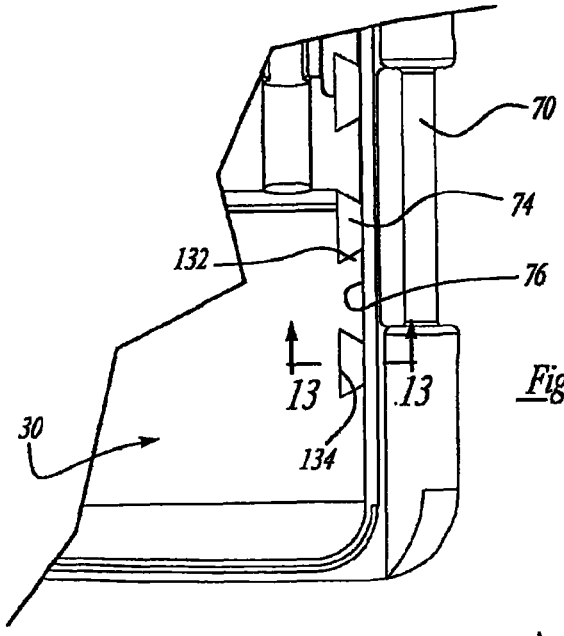
FIG. 12 is an enlarged partial plan view of FIG. 2 along line 12-12 thereof.
Figure 13:
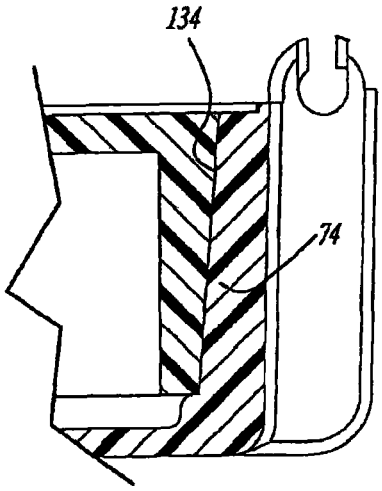
FIG. 13 is a cross-section view of FIG. 12 along line 13-13 thereof.
Figure 14:
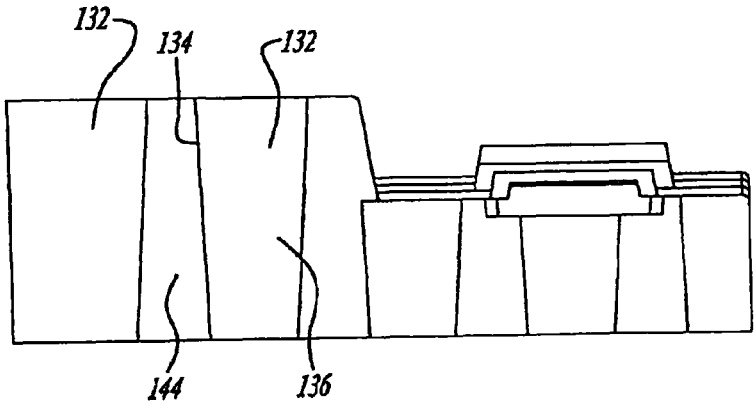
FIG. 14 is a plan view along arrow 14 of FIG. 5.
Figure 15:
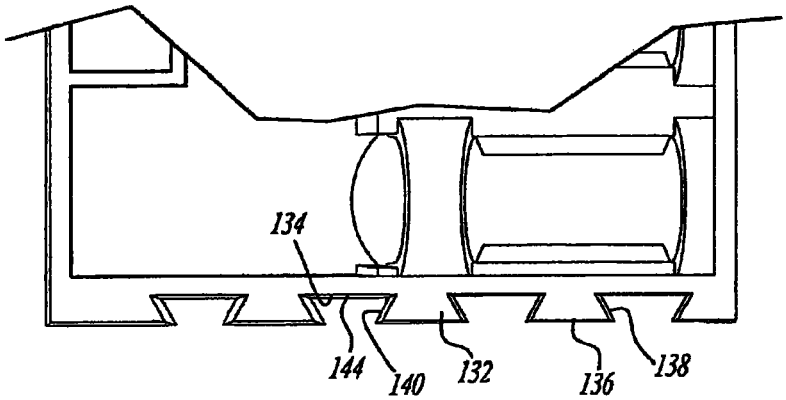
FIG. 15 is a partial plan view of the insert of FIG. 5.
Figure 21:
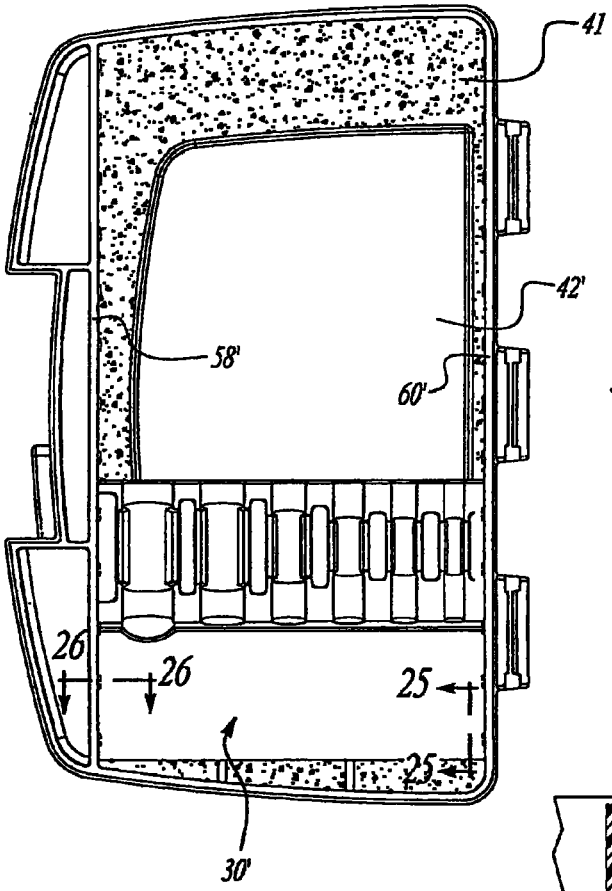
FIG. 21 is a view like FIG. 2 of an alternate embodiment of the present invention.
Figure 25:
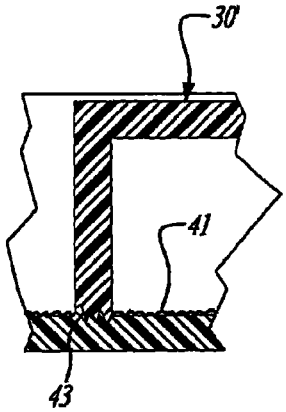
FIG. 25 is a cross-section view of FIG. 21 along lines 25-25 thereof.

In FIG. 9, the latch 92 has an overall rectangular shape. The latch is formed from a first rigid polypropylene member 95 and a second krayton soft cover 97. The cover is molded on top of the rigid base 95 to provide a soft gripping surface for the user. The cover follows the contour of the first member 94. Thus, the latch 92 has an outer arcuate surface adapted to be contacted by the user's thumb. The arcuate surface enables the thumb to rotate and have an ergonomic feel as it is moved between the locked and unlocked positions. The outer arcuate surface 99 includes indicia 100 formed in the cover member 97. The indicia indicates the locked and unlocked position. Also, as shown in FIGS. 6 and 11, the first member 95 includes indicia members 102 and 104 which project into the cover 97. The indicia members 102 and 104 also have an arcuate outer surface consistent with the contour of the first member 94. The indicia 102 and 104 are arrows indicating movement of the latch 92 and are flush with the cover 97 as illustrated in FIG. 9. Also, the arrows 102 and 104 are preferably yellow in color while the cover as well as indicia 100 are black. This provides a contrasting aesthetic appearance for the user.

The latch 92 also includes a channel 106 for receiving the rail portions 94 and 96. The channel 106 is defined by an arcuate base 108, a pair of opposing side walls 110 and 112, and a pair of opposing flanges 114 and 116 extending toward one another from the walls 110 and 112. Thus, the channel 106 includes an arcuate base 108 which conforms to the arcuate rails and has flanges 110, 112 to secure with the ends 111, 113 of the rails 90. Also, one of the flanges 114 includes a cut-out portion 118. The width of the channel between the flanges is substantially constant. However, at the cut-out 118, the width is larger than the remaining channel. Thus, as flange 116 is captured under rail end 113, and cut-out 118 contacts rail end 111, the larger width channel at the cut-out 118 enables flange 114 to easily snap on to rail end 111, to secure the latch 92 with the rails 90. Also, the arcuate surface 108 is arcuate along the channel axis as well as transverse to the channel axis. Thus, the surface 108 is arcuate in two directions to follow the contour of the rail. The substantially matching arcuateness of both the channel and the rails enables smooth movement of the latch 92 along the rail 90.

The tool-retaining inserts 30, 32, 34, 36, 37 include a plurality of tool-receiving recesses 120 and a plurality of tool-retaining fingers 124. The tool is placed into the recess and is maintained in the recess by the retaining fingers 124. The tool retaining inserts 30, 32 may have a stepped configuration with a plurality of curved cut-outs 126 enabling the tools to be inserted into the stepped portion to receive the tools.

The sides of the inserts 30, 32, 34, 36, 37 include mating tenons and recesses 132 and 134 to mate, respectively, with recesses 76 and tenons 74, respectively, of the housing members 22, 24 (see FIGS. 14-17). The tenons 132 have angled front faces 136 and angled sides 138 and 140. They are angled with respect to the vertical at an angle of about one (1°) and two (2°) degrees, respectively. Also, the tenons 132 are larger at the top and smaller at the bottom of the insert to provide an overall trapezoidal shape. The recesses 134 are defined by the walls 138, 140 of the tenons and include an angled base 144. The base is larger at the bottom and smaller at the top of the insert to provide an overall trapezoidal shape. Thus, the tool retaining insert 30, 32, 34, 36, 37 is positioned inside of the housing members 22, 24 so that a wedging friction fit is maintained between the housing members and the inserts. The friction fit is such that the tool retaining inserts are substantially permanently maintained in the housing halves.

Figure 16:
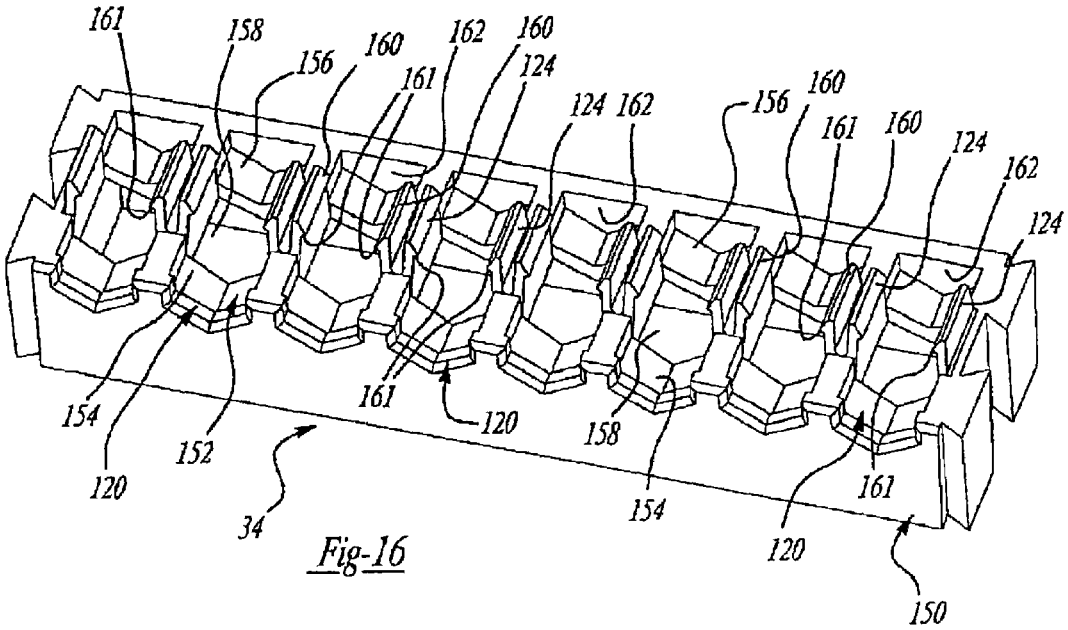
FIG. 16 is a perspective view of a tool receiving insert in accordance with the present invention.
Figure 17:
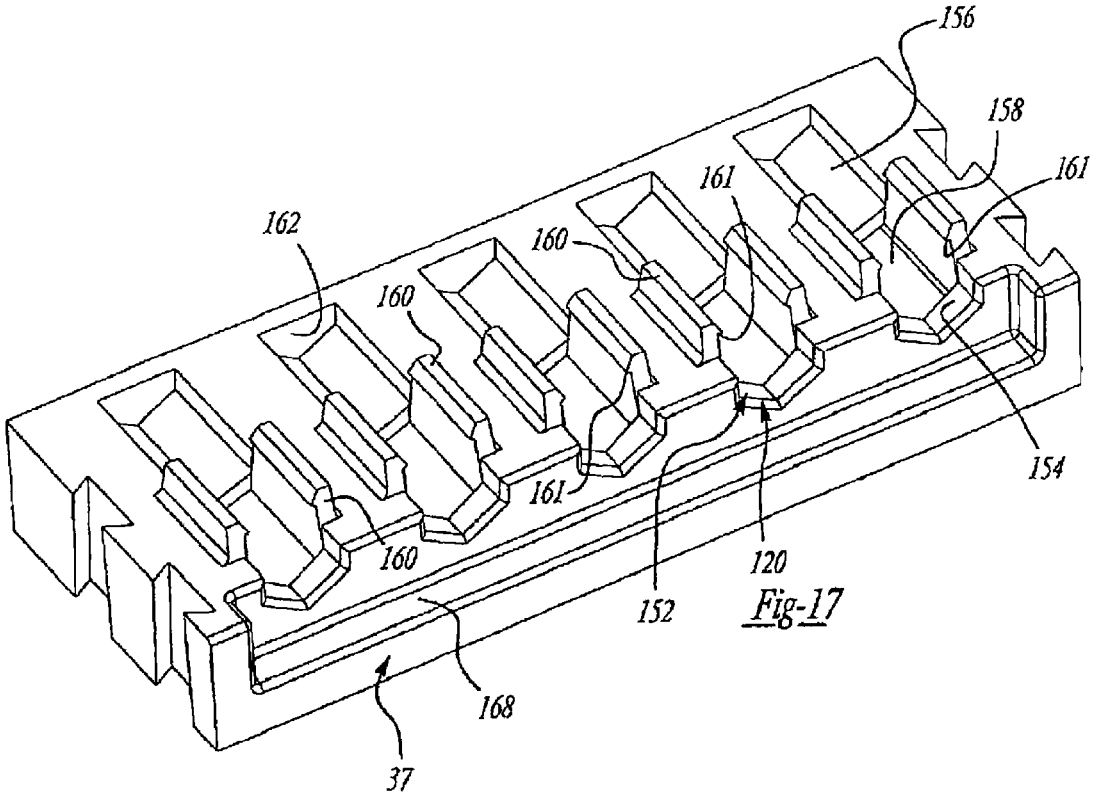
FIG. 17 is a perspective view of another tool receiving insert of the present invention.

Turn to FIGS. 16 and 17 for a better understanding of the inserts 34, 36, 37. FIG. 16 illustrates a perspective view of the insert 34. Here, the insert 34 has a body 150 with eight tool receiving recesses 120. Each tool receiving recess 120 includes a pair of tool retaining fingers 124 on each side of the tool receiving recess 120. The tool receiving recesses 120 include a V-shaped tool receiving cradle 152. The V-shaped tool receiving cradle 152 is separated into two cradle portions 154 and 156 by an aperture 158. The aperture 158 enhances the molding of the insert as well as providing flex for the fingers 124 when they are spread apart to receive a tool as will be described herein.

The fingers 124 are positioned adjacent the aperture 158 and include a barbed member 160 at the free end of the fingers 124. The barbs 160 include a flat surface 161 which helps to retain a tool bit in the V-shaped cradle 152. Also, a wall member 162 is positioned on one side of the tool receiving cradles 152. The wall 162 provides an abutment surface to help in the positioning of tools within the cradle 152. The insert 34 has a longitudinal length of about three-quarters (¾") of an inch. The insert 36 is substantially the same as insert 34 except the insert 36 has a longitudinal length about two and one-half (2½) times that of insert 34. Thus, a pan portion 164 is formed between the wall 162 and second cradle portion 156. The insert 36 has eight receiving recesses 120 like those described in insert 34.

Turning to FIG. 17, insert 37 is illustrated. Insert 37 is similar to insert 34 except that insert 37 includes five tool receiving recesses 120. The tool receiving recesses are substantially the same as those previously described, having a V-shaped cradle 152 as well as the fingers 124. The insert 37 includes a stepped portion 168 which enables other types of tools such as sockets to be retained in the insert 37. However, any cradle shape having an apex would be able to receive a tool apex.

Figure 18:
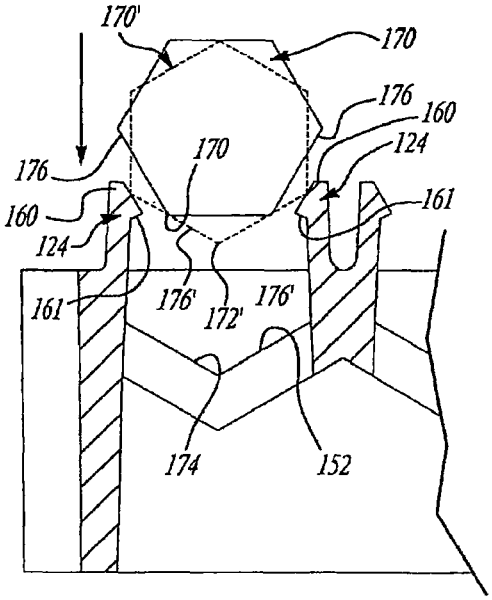
FIG. 18 is a cross-section view of FIG. 16 along line 18-18 thereof.
Figure 19:
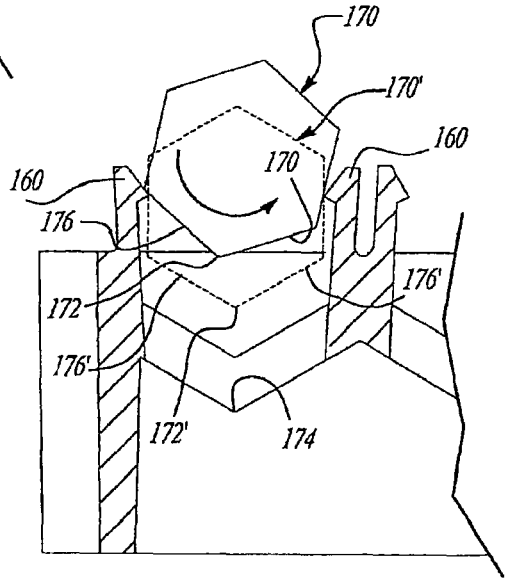
FIG. 19 is a view like FIG. 18 with the tool in a second position.
Figure 20:
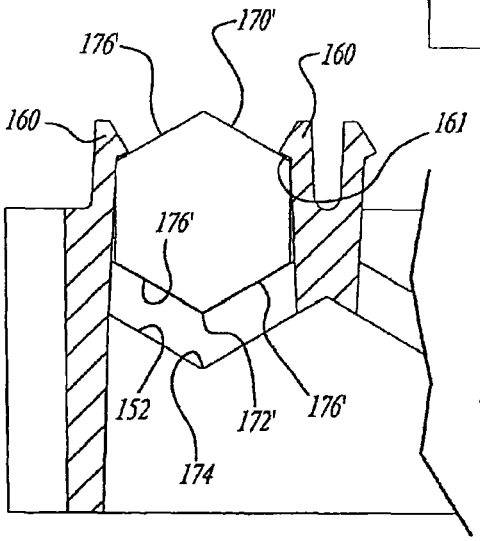
FIG. 20 is a view like FIG. 18 with the tool in a seated position.

FIGS. 18-20 illustrate the insertion of a polygonal cross-section shaped tool into the fingers 124. As shown in FIG. 18, a tool bit 170 is positioned on top of barbs 160 of the fingers 124. The tool 170 has a hexagonal cross-section with a flat portion spanning between the two fingers 124. As the tool 170 is forced through the fingers 124, the fingers 124 spread apart with respect to one another. As the fingers 124 spread, the barbs 160 rotate the tool 170. The rotation continues until a pair of flats 176 are between the opposing barbs 160. At that time, the tool 170 is self-orientated with an apex 172 pointed forward of the apex 174 of the V-shaped cradle. The tool 170 is continued to be forced down into the V-shaped cradle as illustrated in FIG. 20. As this occurs, the apex 172 of the tool seats into the apex 174 of the V-shaped cradle. Thus, the fingers 124 act to self-align or self-orientate the tool 170 in the V-shaped cradle 152. Thus, the V-shaped cradle 152 receives the tool 170 prohibiting any loose tools within the container. Also, the fingers and V-shaped cradle instantly locate the tool bit 170 in position in the tool receiving recess. The barb surfaces 161 seat on a flat surface 176 of the tool 170 to retain the tool within the recess. In the event an apex 172 of the tool 170 is pointing toward the apex 174 of cradle 152, as shown in phantom in FIG. 18, the fingers 124 spread and allow the tool 170 to drop directly into the cradle 152 with the tool apex 174 aligned to seat in cradle apex 172.

Turning to FIGS. 21-26, a second embodiment of the invention is shown.

Here, the housing members are the same as previously discussed, except that the dove-tail walls are replaced by flat walls. Likewise, the tool retaining inserts have flat side walls.

In their place, the base 42', or the side walls 58', 60', have a roughed raised surface 41. Likewise, the inserts 30' include side walls and a base which include similar roughed surfaces 43. These roughed surfaces 41, 43 with the raised and lowered portions enhance ultrasonic welding. The inserts may be ultrasonically welded, adhered or glued to the pair of housing members.

Figure 22:
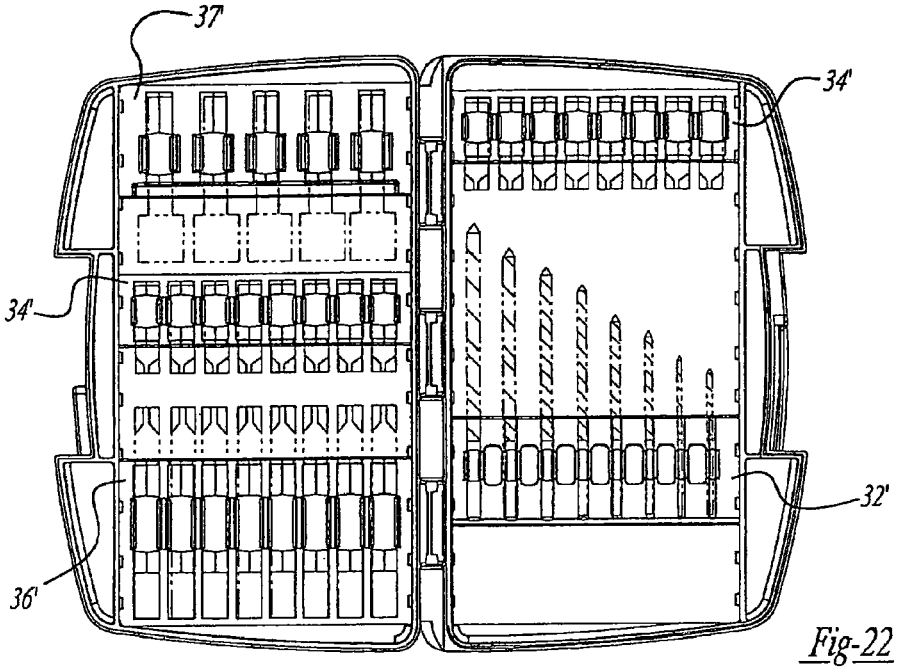
FIG. 22 is a view like FIG. 3 of the alternate embodiment of FIG. 21.
Figure 23:
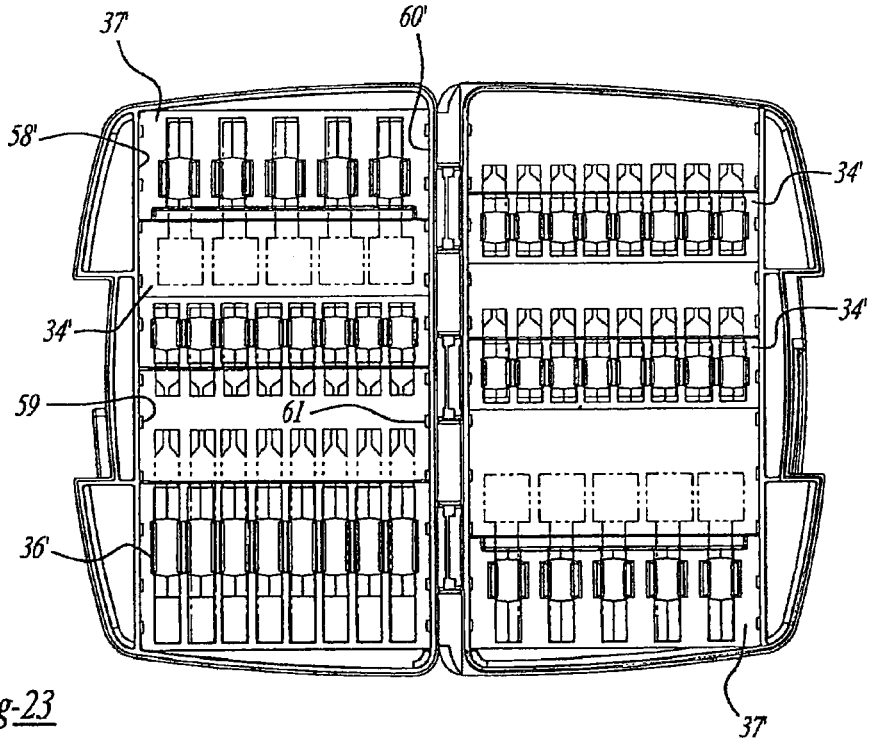
FIG. 23 is a view like FIG. 4 of the alternate embodiment of FIG. 21.
Figure 26:
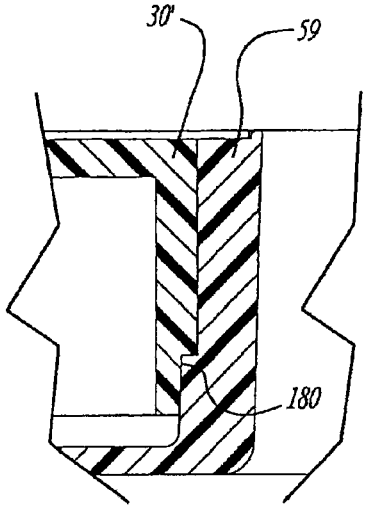
FIG. 26 is a cross-section view of FIG. 21 along lines 26-26 thereof.
Figure 24:
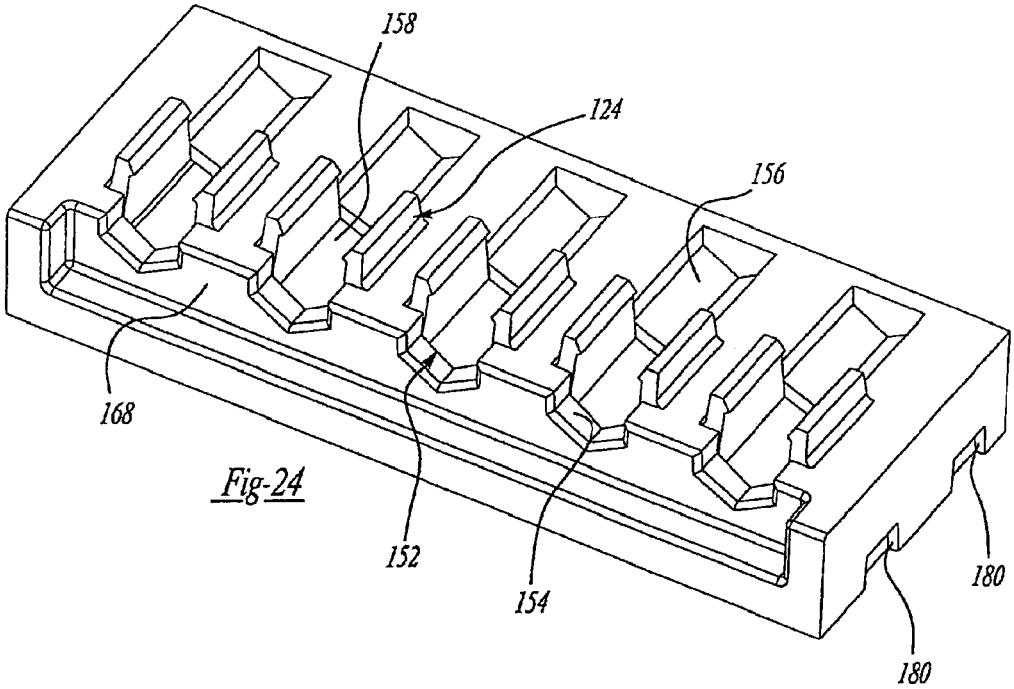
FIG. 24 is a partial perspective view of an insert of FIG. 22 or 23.

FIGS. 22 and 23 illustrate the second embodiment like FIGS. 3 and 4. Here, like FIGS. 3 and 4, the inserts 34', 36', 37' may be positioned in multiple places or positions within the container. Also, the inserts 34', 36', 37' include the receiving members 120 and finger members 124 as well as the V-shaped cradles 152 as explained above. The difference between the previous embodiment is the sides of the inserts.

The walls 58' and 60' include tenons or projecting members 59 and 61. These projecting members 59, 61 are spaced along and do not extend the entire height of the walls 58 and 60'. The projecting members 59 and 61 act to position the inserts 30', 32', 34', 36', 37' in the container to allow for the multiple positioning of the inserts within the housing member. The inserts include recesses or cut-outs 180 which receive the projecting members 59 and 61. The cut-outs 180 are sized to receive the projecting members 59, 61 and are positioned such that the projecting members position the inserts along the housing member. The mating of the projecting member 59, 61 and recess or cut-out 180 enable the inserts to then be adhesively glued or ultrasonically welded to be secured with the housing member.

In the case of the inserts 34', 36' and 37', the insert 34' and the insert 37' would ordinarily include a single cut-out or recess 180 while the insert 36' would include two or three recesses 180 to receive the projecting members 59 and 61. Also, it should be noted that the projecting members could be positioned onto the inserts while the recesses could be formed within the walls 58' and 60'.

While the above detailed description describes the preferred embodiment of the present invention, the invention is susceptible to modification, variation, and alteration without deviating from the scope and fair meaning of the subjoined claims.

The invention claimed is:

1. A tool container comprising:

two housing members pivotally coupled with one another for opening and closing with respect to one another, at least one housing member defining a cavity for receiving tools, said cavity defined by a base and a wall extending from said base, at least one of said housing member base or wall having a roughed surface for enhancing securement;

an insert for retaining tools, said insert permanently secured in said cavity, said insert having a surface for securing with said member base or wall; and said insert surface being in contact with said base or wall, and wherein the insert surface, base, or wall are fixed together.

2. The tool container of claim 1 wherein said insert is glued, adhered or welded to said base or wall.

3. The tool container of claim 1 further comprising:

a plurality of tool bits;

each housing member has an inner surface and an outer surface, the inner surface defines the cavity defined by the base and the wall extending from the base, the outer surface defines an exterior surface of the tool container;

a plurality of recesses on the peripheral wall of the inner surface in each of the housing members;

a plurality of additional inserts, each additional insert configured to retain one or more of the plurality of tool bits, each of the additional inserts having a body and a pair of end faces, the body defining a plurality of openings, each opening having a dimension substantially the same as one of the tool bits to frictionally retain that tool bit, and the pair of end faces each including at least one projection configured to cooperate with the recesses in each of the peripheral walls;

wherein each additional insert is configured to be multi-positionable and secured against movement along the peripheral walls and away from the base in each of the housing members in a plurality of positions along each of the walls by frictional engagement of the projections with corresponding ones of the plurality of recesses.

4. The tool container according to claim 3, further comprising a plurality of alternating tenons adjacent said plurality of recesses forming a plurality of alternating dovetail recesses and tenons.

5. The tool container according to claim 4, wherein said tenons each have a front face being angled at about one (1°) degree with respect to vertical.

6. The tool container according to claim 4, wherein said recesses each have faces at angles for locking the projections and recesses together.

7. The tool container according to claim 3, wherein at least one of the plurality of additional inserts has at least one retaining finger being adjacent said tool bit receiving opening for further retaining the tool bits in the tool receiving openings.

8. The tool container according to claim 3, wherein at least one of said plurality of additional inserts has a bit receiving mechanism for self-orientating the tool bit in said additional insert.

9. The tool container according to claim 4, wherein said plurality of additional inserts projections each have alternating tenons and grooves for mating with said recesses and tenons adjacent the peripheral wall.

10. The tool container according to claim 3, wherein at least one of said plurality of additional inserts is permanently secured in said housing member.

11. The tool container according to claim 3, wherein at least one of said plurality of additional inserts is removably secured in said housing member.

* * * * *